US008781803B2

(12) United States Patent
Rio et al.

(10) Patent No.: US 8,781,803 B2
(45) Date of Patent: Jul. 15, 2014

(54) METHOD AND DEVICE FOR GENERATING AND PUBLISHING A RAILWAY SIGNALING DIAGRAM

(75) Inventors: Aude Flore Rio, Paris (FR); Marianne Rasoamanana, Malakoff (FR); Pascal Dumont, Mantes la Jolie (FR)

(73) Assignee: Alstom Transport, SA, Levallois-Perret (FR)

( * ) Notice: Subject to any disclaimer, the term of this patent is extended or adjusted under 35 U.S.C. 154(b) by 184 days.

(21) Appl. No.: 13/231,531

(22) Filed: Sep. 13, 2011

(65) Prior Publication Data

US 2012/0234986 A1 Sep. 20, 2012

(30) Foreign Application Priority Data

Sep. 13, 2010 (FR) ..... 10 57256

(51) Int. Cl.
*G06F 17/10* (2006.01)
*B61L 27/00* (2006.01)

(52) U.S. Cl.
CPC ..... *B61L 27/0055* (2013.01)
USPC ..... 703/6; 701/19

(58) Field of Classification Search
CPC ..... G09B 19/14; B61L 27/0055; B61L 27/00; B61L 27/0005; B61L 21/06
USPC ..... 703/6; 701/19
See application file for complete search history.

(56) References Cited

U.S. PATENT DOCUMENTS

| | | | | |
|---|---|---|---|---|
| 6,125,311 | A * | 9/2000 | Lo | 701/19 |
| 7,340,328 | B2 * | 3/2008 | Matheson et al. | 701/19 |
| 2004/0093245 | A1 * | 5/2004 | Matheson et al. | 705/7 |

FOREIGN PATENT DOCUMENTS

| | | |
|---|---|---|
| DE | 10147459 | 6/2005 |
| DE | 102005034252 | 2/2007 |
| WO | 03/070537 | 8/2003 |

OTHER PUBLICATIONS

Nash et al. "Railroad Simulation Using OpenTrack"., http://www.opentrack.ch/opentrack/opentrack_e/opentrack_e.html#Document., 2004. 10 pages.*
Hansen., "Railway Network Timetabling and Dynamic Traffic Management"., Sep. 27-28, 2009., ECRARE-2009., p. 135-145.*
Aust et al., "Test-Und Simulationssoftware für ESTW", Signal+Draht, Dec. 1, 2007, pp. 13-16, vol. 99.
Berger et al., "Euro-Interlocking Pilot Projekt Data Preparaion bei den Österreichischen Bundesbahnen", Signal+Draht, Nov. 1, 2005, pp. 16-19, vol. 97.
Lodemann et al., "Beschreibung von Eisenbahninfrastrukturen mit railML und ihre Verifikation", Signal+Draht, Apr. 1, 2010, pp. 37-42, vol. 102.
Paradi et al., "BEST—Betriebs-und Stellwerkssimulation als Planungs-und Projekttierungshilfsmittel für ESTW", Signal+Draht, Jan. 1, 1997, pp. 27-30, vol. 89.

* cited by examiner

*Primary Examiner* — Eunhee Kim
(74) *Attorney, Agent, or Firm* — Thompson Coburn LLP

(57) ABSTRACT

The invention relates to method and device for generating and publishing a railway signaling diagram comprising a track diagram of a railway network and track equipment arranged on the network portion, each piece of track equipment comprising particular characteristics. One method of the invention comprises: (a) entry by a user of topological data of the portion of the railway network; (b) automatic generation by the computation means of a track diagram of the portion of the railway network from topological data; (c) selection by the user of a plurality of rules for positioning track equipment to be arranged on the railway track diagram, and (d) automatic generation by the computation means of the railway signaling diagram of the portion of the network from selected rules for positioning the track equipment and the railway diagram. The invention also relates to a device adapted to carry out the preceding method.

6 Claims, 3 Drawing Sheets

METHOD AND DEVICE FOR GENERATING AND PUBLISHING A RAILWAY SIGNALING DIAGRAM

CROSS-REFERENCE AND PRIORITY CLAIM TO RELATED APPLICATION

This patent application claims priority to French Application No. FR 10 57256, filed Sep. 13, 2010, and entitled "Method and Device for Generating and Publishing a Railway Signaling Diagram," the entire disclosure of which is incorporated herein by reference.

BACKGROUND

Traditionally, to produce a railway signaling diagram, it is necessary to graphically reproduce the outline of the railway track portion according to the topological information. The outline of the railway track portion is typically referred to as a "diagram" or "track plan." Then, pieces of track equipment, such as signaling elements, are positioned on the track plan, depending on the type of equipment that will travel there and the standards in force in the country. Exemplary signaling elements include clearance points, signals, indicators, etc. Lastly, control tables and interlocking tables applicable to the signals and the possible itineraries on the railway track portion are generated. These tables are very useful to the station agent in order to manage the railway traffic. For example, an interlocking table for a given itinerary includes all of the actions performed by the different control members of the track equipment or signals with the aim of allowing the passage of a railway vehicle in a direction only when all of the necessary safety conditions for that movement are met.

To meet safety conditions, rules for positioning the different track equipment known by those skilled in the art are used to generate each railway signaling diagram. For example, a train must not embark on a track segment of the network if the following four segments are not free, i.e., if one of them is occupied by another railway vehicle. As a result, it is necessary to position a panel upstream of the track segment signaling whether or not the train can embark there. The position of the panel is determined between, among other things, the speed of the trains traveling on the network so as to provide a stopping distance for the train if the following segments are not free.

A typical railway signaling diagram is generated by several operators as a function of their specialty. Each operator implements the railway signaling diagram with track equipment for which he is responsible and according to positioning rules specific to him. He can modify equipment added by other operators. Furthermore, the rules used for the generation may be different from one operator to the next and are not mentioned in the final version of the railway signaling diagram. Furthermore, the signaling diagram is traditionally implemented successively by the operators on a paper version of the track diagram, causing a long process of generating the complete and definitive version of the signaling diagram.

Thus, a need exists and the present invention aims to provide a method and a device for generating and publishing a railway signaling diagram in a standardized and automatic manner, thereby allowing the diagram to be generated reliably and quickly.

SUMMARY OF THE INVENTION

The invention applies to the railway field and more particularly the generation and publishing of railway signaling diagrams or technical plans for a railway installation. More particularly, the present invention relates to a method for generating and publishing a railway signaling diagram comprising a track diagram of a railway network and track equipment arranged on the network portion, each piece of track equipment comprising particular characteristics, the method comprising the following steps:

entry by a user of topological data of the portion of the railway network; and automatic generation by the computation means of a track diagram of the portion of the railway network from topological data;

selection by the user of a plurality of rules for positioning track equipment to be arranged on the railway track diagram; and automatic generation by the computation means of the railway signaling diagram of the portion of the network from selected rules for positioning the track equipment and the railway diagram.

According to specific embodiments, the method for generating and publishing a railway signaling diagram includes one or more of the following features, considered alone or in combination:

a step for selection, by the user, of the order to carry out the positioning rules selected for the track equipment;

a step for manual modification by another user of at least one particular characteristic of a piece of track equipment of the railway signaling diagram generated by at least one user;

a step for automatic verification of the manual modification according to the chosen rules;

a step for saving the generated signaling diagram, the rules used to generate it and any changes made; and the following steps:

automatic generation by the computation means of the possible itinerary on the railway track portion from the generated railway signaling diagram, and automatic generation by the computation means of an interlocking table for each possible itinerary of the railway track network.

The invention also relates to a device implementing the method for generating and publishing a railway signaling diagram. More particularly, the invention also relates to a device for generating and publishing a railway signaling diagram comprising a portion of a railway track network and track equipment arranged on a network portion, each piece of track equipment comprising particular characteristics, characterized in that it has:

a first database comprising a plurality of topological information of the portion of the railway track network, computation means adapted to automatically generate a railway track plan from the first database, a second database comprising the characteristics and a plurality of rules for positioning each piece of track equipment, at least one man-machine interface adapted to choose the rules of the second database to be applied, and in that the computation means are adapted to automatically generate a railway signaling diagram from a track plan and selected positioning rules.

According to one particular embodiment, the device for generating and publishing a railway signaling diagram is adapted to implement the preceding method for generating and publishing a railway signaling diagram.

BRIEF DESCRIPTION OF THE DRAWINGS

The invention will be better understood upon reading the following description, provided solely as an example, and done in reference to the drawings, in which.

DETAILED DESCRIPTION OF THE INVENTION

The invention relates to a device for generating and publishing a railway signaling diagram intended to be shared by a plurality of services or operators involved in producing the signaling diagram. In addition to the outline or plan of tracks, such a signaling diagram may also be used to convey information to railway installation groups such as topological information such as the position of the train stations, rails, switch points, altitude differences and curve radii as well as the track equipment such as lights, signals, and beacons. Such signaling diagrams may be generated while respecting constraints expressed by standards and by a client, for example in terms of track availability, travel speed of the equipment to obtain a certain traffic flow.

Figure 1:
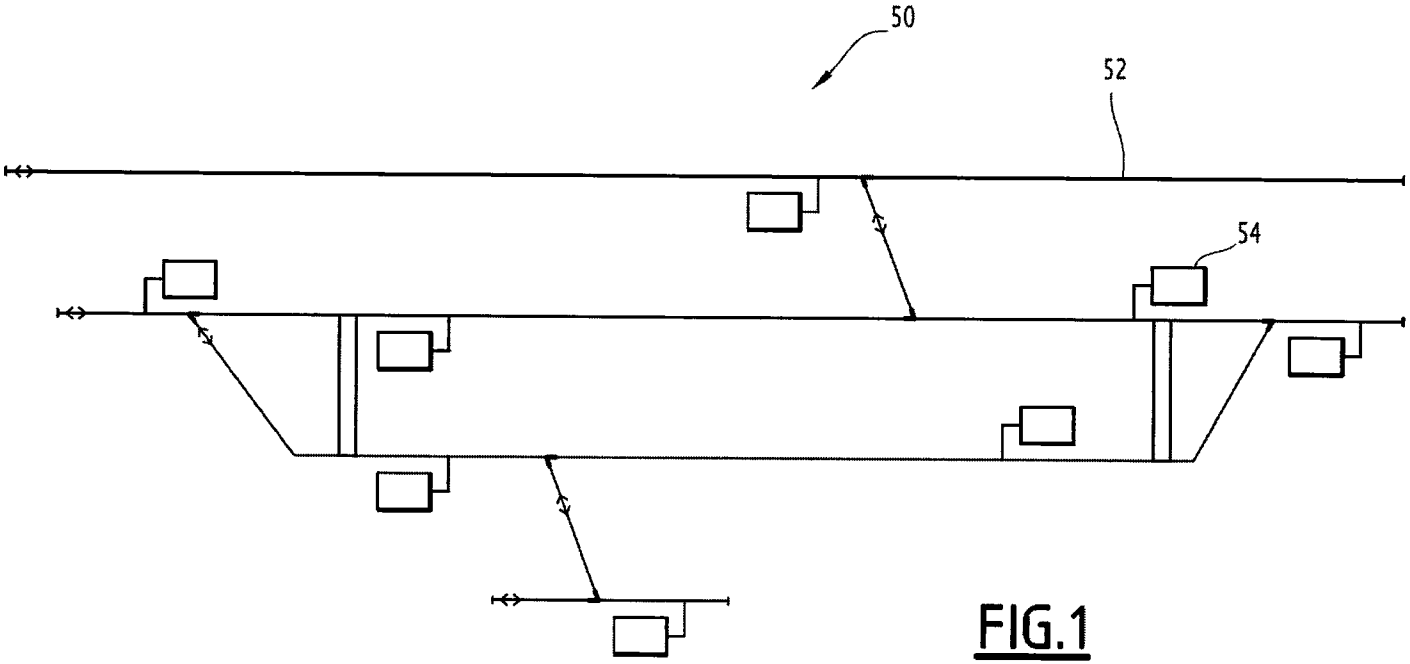
FIG. 1 is a summary diagram of an example of a signaling diagram.

Regarding FIG. 1, the railway signaling diagram 50 comprises the outline 52 or diagram of a portion of a railway track network and icons 54 representing track equipment arranged on the network portion. In a known manner, the track equipment is for example switches, signal lights, clearance points, etc.

The device according to the invention can automatically generate the signaling diagram by applying predefined rules for positioning track equipment incorporated in the diagram, as will be detailed later.

Figure 2:
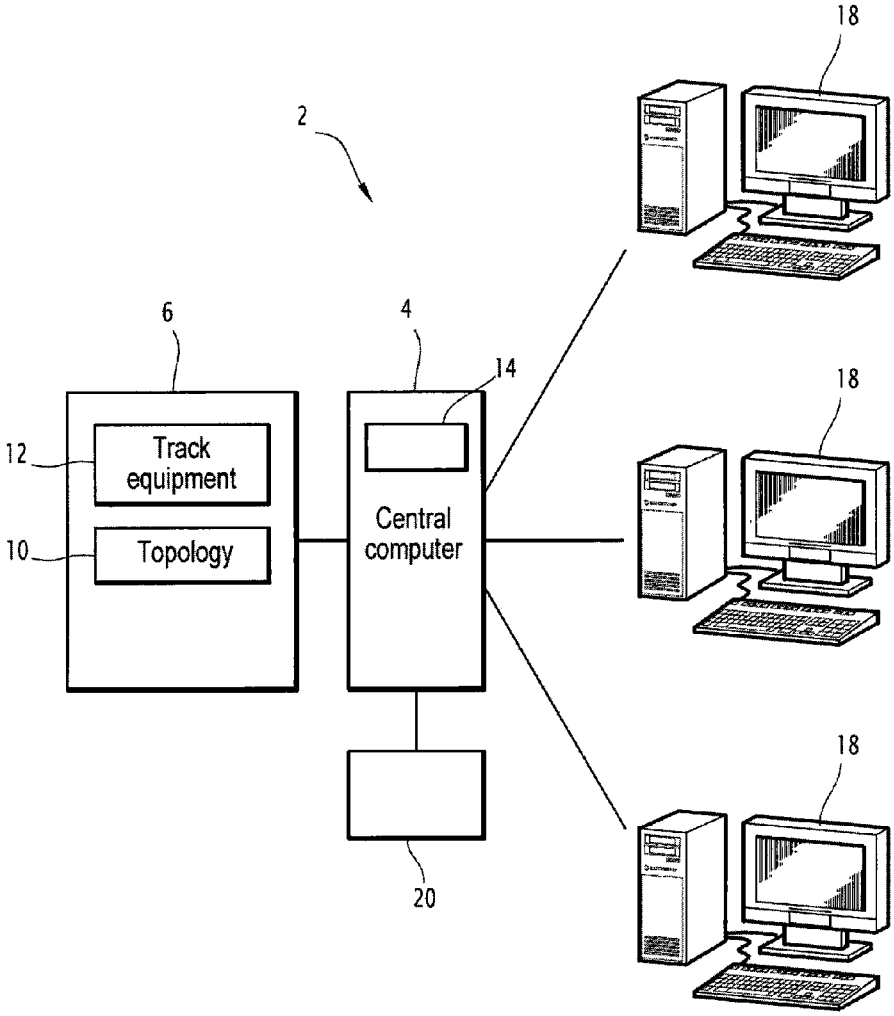
FIG. 2 is a summary diagram of an embodiment of a device for generating and publishing a railway signaling diagram according to the invention.

FIG. 2 illustrates a device 2 according to the invention that comprises a central computer 4 and a storage unit 6 connected to the central computer 4.

The storage unit 6 includes a first database 10 comprising topological information of the portion of the railway track network making it possible to define the track plan.

It also comprises a second database 12 having characteristics unique to each piece of track equipment, for example, the name of the equipment, its position, the types and statuses of the track equipment, for example for a switch, a signal light, etc.

Furthermore, the second database 12 comprises a plurality of rules for positioning track equipment as a function of the standards and client constraints. One example of a rule was provided earlier.

Of course, the first database 10 and the second database 12 can form a single database containing the topological information for the portion of the railway track network, the characteristics specific to each piece of track equipment and a plurality of rules for positioning the track equipment.

The central computer 4 has computation means 14 adapted to automatically generate a railway track plan from the first database 10.

Moreover, these computation means 14 are adapted to automatically generate the railway signaling diagram from the generated track plan and positioning rules from the second database 12.

The device 2 also comprises a plurality of man-machine interfaces 18, such as remote terminals, each being connected to the central computer 4 and adapted to choose, by an operator, the rules of the second database to be applied, to potentially modify the generated railway signaling diagram and to display the railway signaling diagram during generation or when it is finalized.

Of course, any number of man-machine interfaces 18 can be considered, three being shown in this figure.

Furthermore, the device has means 20 for publishing the generated railway signaling diagram, for example means for printing or publishing plans of the AutoCAD® type, commonly used in the railway field.

Figure 3:
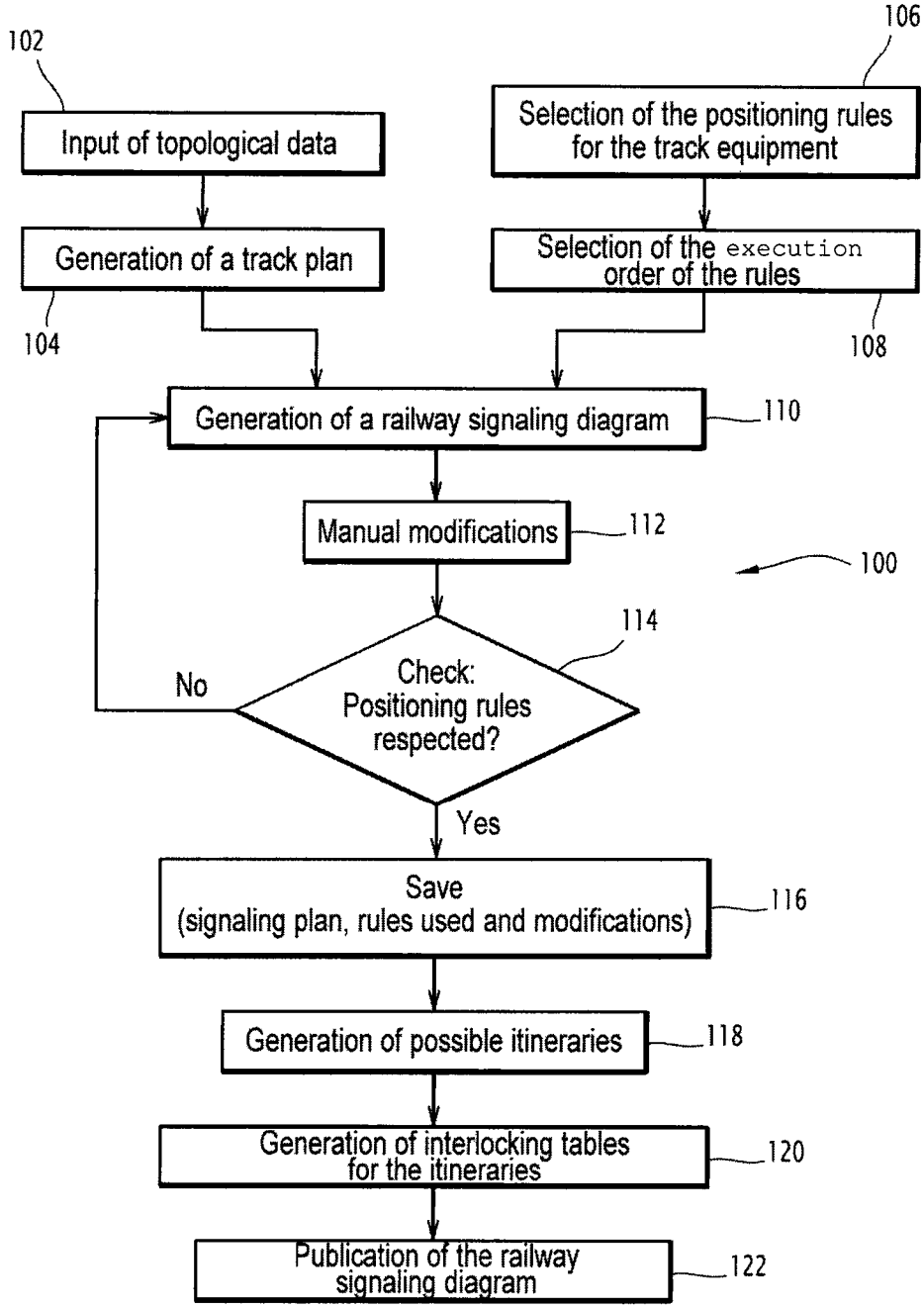
FIG. 3 is a block diagram illustrating a method for generating and publishing a railway signaling diagram implemented by the device of FIG. 2.

The inventive device 2 is adapted to use the method 100 for generating and publishing a railway signaling diagram that will now be described in light of FIG. 3.

The method comprises a step 102 for an operator to input topological data for the portion of the railway network such as altitude changes of the studied portion of the railway network. This topological data is saved in the first database 10 of the storage unit 6.

This step 102 is followed by step 104 for automatic generation by the computation means 14 of the central computer 4 of a plan of the tracks of the portion of the railway network from topological data contained in the first database 10.

The track plan includes the outline of the railway tracks of the portion of the railway network.

Furthermore, the method includes a step 106 for the selection by the operator of a plurality of pieces of track equipment to be arranged on the track plan and positioning rules associated with a predefined set of track equipment. Each piece of track equipment is associated with particular characteristics such as its position, its operating status as a function of standards and safety rules, a standardized icon in the railway field, etc. All of these characteristics have been stored beforehand in the second database 12 of the storage unit 6.

For example, the operator selects, in the second database 12, a plurality of rules as a function of the standards, equipment to be inserted and constraints imposed by the client.

Then, during step 108, the operator chooses the order to carry out the selected rules for positioning the pieces of track equipment by classifying them by sequences of operations to be performed.

For example, in a known manner, the first sequence concerns the clearance points:

Computing a switch point distance: clearance point for a given switch type and recording the value in the storage unit 6.

Positioning a clearance point at the computed distance from each switch of the diagram.

Other sequences of rules concern the definition of the points of the railway network to be protected (clearance point, switch, etc.), the generation of the stop signal and warning and the computation of the position of the signaling panels of the signals, etc.

During this step, the operator can modify the characteristics of certain rules recorded in the storage unit 6.

The method also comprises a step 110 for automatic generation by the computation means 14 of the railway signaling diagram of the portion of the network from selected rules for positioning the track equipment and the railway track plan.

In particular, the computation means 14 compute the position of each piece of track equipment using a positioning rule selected from the second database 12.

The computation means 14 insert to scale, in the track plan, the icons for each piece of track equipment relative to their signals as a function of their computed position.

To that end, the computation means 14 use the rules of the second database 12 to detect the points of the track diagram to be protected and place a signal in front of it.

Moreover, they cut the portion of the network into zones between two consecutive signals.

The signaling diagram thus generated then includes the outline of the railway tracks and the track equipment inserted thereon, for example: the kilometric points, switches, grade crossings, bridges, tunnels, etc., as well as their signaling elements such as signals and signal panels.

Another operator manually modifies, if he wishes or if necessary, at least one particular characteristic of a piece of track equipment of the railway signaling diagram generated during step 112. During that step, the reason for its modification and the rule(s) used are requested by the computation means 14. That data and its date are recorded in the storage unit 6 of the device 2.

Subsequently, step 114 is carried out by the computation means 14 in order to automatically verify that the manual change(s) made are in compliance with the chosen rules and the client's constraints.

If the positioning rules have been respected, step 116 for saving the generated signaling plan is carried out by the central computer in the storage unit 6. During that step, the rules used to generate the signaling diagram and any changes made are also saved.

The respective steps 118 and 120 of the method 100 make it possible for the computation means 14 to automatically generate, on the one hand, possible itineraries on the railway track portion from the generated railway signaling diagram and, on the other hand, an interlocking table for each possible itinerary of the railway track network.

The computation means 14 compute all of the itineraries, i.e. all of the journeys between two signals, of the portion of the network, taking into account the physical constraints, for example the encountered track equipment, then eliminates the impossible itineraries.

The interlocking table is computed by the computation means 14 from rules incorporated into the second database 12, by deducing status conditions of the signals for each possible itinerary of the track equipment of the railway signaling diagram.

The method also includes a step 122 for publishing a railway signaling diagram by the publishing means 20, for example the diagram is printed on paper.

One of the advantages of the device 2 is that it makes it possible to ensure that all of the operators working on a same railway signaling diagram to be generated use the same rules. It also ensures traceability of the modification of the rules, since the manual changes are recorded.

Furthermore, the device allows the different operators to view the railway signaling diagram all throughout its design to validate and/or modify the different steps of its generation in real-time. This visualization makes it possible to manage deviations between the applicable rules and the client's choices.

Furthermore, this device makes it possible to generate and publish the interlocking tables associated with each signaling element as a function of the selected rules quickly, unlike the state of the art, in which these tables cannot be published before the signaling diagram is printed to scale.

Furthermore, the published railway signaling diagram is complete and verified.

All of this data can be published in a RailML file, which is an interchange file type known in the railway field between a plurality of devices.

This device and the associated method make it possible to centralize and obtain a great availability of the data concerning a railway signaling diagram of a same portion of a railway network, thereby creating a gain in time and reliability.

The invention claimed is:

1. A method for generating and publishing a railway signaling diagram comprising a track plan of a portion of a railway track network and track equipment arranged on the portion of the railway track network, each piece of track equipment comprising particular characteristics, the method comprising the following steps:

entry by a user of topological data for the portion of the railway track network;

automatic generation by a computer of the track plan of the portion of the railway track network from the topological data;

selection by the user of a plurality of rules for positioning track equipment to be arranged on the track plan;

automatic generation by the computer of the railway signaling diagram of the portion of the railway track network from selected rules for positioning the track equipment and the track plan;

automatic generation by the computer of a possible itinerary on the portion of the railway track network from the generated railway signaling diagram; and automatic generation by the computer of an interlocking frame for each possible itinerary of the railway track network.

2. The method for generating and publishing a railway signaling diagram according to claim 1, further comprising selection, by the user, of the order to carry out the positioning rules selected for the track equipment.

3. The method according to claim 1, further comprising manual modification by another user of at least one particular characteristic of a piece of track equipment of the railway signaling diagram generated by at least one user.

4. The method according to claim 3, further comprising automatic verification of the manual modification according to the chosen rules.

5. The method according to claim 3, further comprising saving the generated signaling diagram, the rules used to generate the railway signaling diagram, and any changes made.

6. A device for generating and publishing a railway signaling diagram comprising a track plan of a portion of a railway track network and track equipment arranged on the portion of the railway track network according to the method of claim 1, each piece of track equipment comprising particular characteristics, the device comprising:

a first database comprising a plurality of topological information of the portion of the railway track network;

a computer adapted to automatically generate the track plan from the first database;

a second database comprising the characteristics and a plurality of rules for positioning each piece of track equipment;

at least one man-machine interface adapted to choose the rules of the second database to be applied; and wherein the computer is adapted to automatically generate a railway signaling diagram from the track plan and selected positioning rules, a possible itinerary on the portion of the railway track network from the generated railway signaling diagram, and an interlocking frame for each possible itinerary of the railway track network.

* * * * *